US005199642A

United States Patent [19]

Rankin

[11] Patent Number: 5,199,642

[45] Date of Patent: Apr. 6, 1993

[54] HIGH PRESSURE WATER SPRAY GUN

[76] Inventor: George J. Rankin, 3620 W. 11th St., Houston, Tex. 77088

[21] Appl. No.: 748,665

[22] Filed: Aug. 22, 1991

[51] Int. Cl.[5] ..... B05B 9/01

[52] U.S. Cl. ..... 239/124; 239/443; 239/526; 137/882; 137/269

[58] Field of Search ..... 239/124, 127, 525, 526, 239/436, 443, 532, 447; 137/881, 882, 269, 315; 42/73

[56] References Cited

U.S. PATENT DOCUMENTS

| | | | |
|---|---|---|---|
| 77,690 | 5/1868 | White | 137/269 |
| 3,137,958 | 6/1964 | Lewis et al. | 42/73 |
| 3,491,948 | 1/1970 | Alexander | 239/127 |
| 3,765,607 | 10/1973 | Pacht | 239/124 |
| 3,885,739 | 5/1975 | Tuttle | 239/526 |
| 3,986,523 | 10/1976 | Pacht | 137/882 |
| 3,987,963 | 10/1976 | Pacht | 239/124 |
| 4,216,911 | 8/1980 | Huperz et al. | 239/526 |
| 4,602,740 | 7/1986 | Stachowiak | 239/124 |
| 4,716,849 | 1/1988 | Conn et al. | 239/526 |

FOREIGN PATENT DOCUMENTS

| | | | |
|---|---|---|---|
| 58573 | 11/1936 | Norway | 239/443 |

*Primary Examiner*—Andres Kashnikow
*Assistant Examiner*—Christopher G. Trainor
*Attorney, Agent, or Firm*—Alton W. Payne

[57] ABSTRACT

A high pressure fluid spray gun comprising an adjustable shoulder support with a rotatable head and a length adjustment mechanism. The high pressure gun also includes a reversible piston and seat operable by a manual trigger for directing the flow of high pressure fluid to discharge either through the gun barrel or to a dump chamber which is mounted on a swivel for convenient adjustment of the alignment of the dump hose. The high pressure inlet hose is connected to a "Y" fitting in the barrel to reduce the back thrust on the operator when the gun is being operated.

9 Claims, 2 Drawing Sheets

HIGH PRESSURE WATER SPRAY GUN

BACKGROUND OF THE INVENTION

Heretofore, high pressure fluid blast guns have presented handling problems to the operator due to the significant forces attendant on gun operation. The reaction forces produced by high pressure fluid tends to make the guns difficult and tiring to handle. Typically an operator has to stand in a crouched or semi-crouched position to brace himself in order to handle the reaction forces produced in the gun by the high pressure fluid. Guns which have standard size and length components require the operators to adjust their posture to accommodate the guns, rather than having a gun brace which can be adjusted to fit the size of the operator. Also, attaching the inlet high pressure hose near the rear of the gun requires the operator to overcome the reaction forces of the gun merely to control it when it is manually operated. This typically requires the operator to use his body to hold the reaction force created by the fluid blaster.

It is an object of the present invention to provide a fluid blast gun that is ergonomically more effective in that it affords some latitude in the length of the shoulder brace to accommodate operators of different sizes.

It is also an object of the present invention to provide a hydroblast gun which has a "Y" fitting on the gun barrel for connecting the high pressure inlet hose forward of the control mechanism to take advantage of the reaction force in the high pressure hose that tends to counteract the thrust from high pressure fluid being discharged from the end of the barrel. Since the high pressure fluid in the high pressure hose tends to straighten the hose, the "Y" fitting in the barrel causes the straightening hose to tend to force the gun forward rather than backward and thereby counteract the end thrust load that is imposed on the operator.

A further object is to provide a high pressure blast gun with a floating valve seat and piston which enables the piston and seat to align perfectly when actuated by the cam action of the gun trigger.

A further object is to provide a high pressure blast gun with a reversible piston and a reversible floating seat which can be aligned with the piston and which can be easily removed from the gun by the operator to enable him to conveniently reverse the piston or seat should they become worn and thus minimize down time required for gun maintenance as well as reduce the cost of wear parts in the gun.

Another object of this invention is to provide a high pressure nozzle with a dump or diverter chamber which is attached to the high pressure piston chamber by means of a swivel mechanism that allows the dump chamber to which the dump hose is connected to be turned or swiveled so as to align the dump hose on either side of the operator.

DESCRIPTION OF THE PREFERRED EMBODIMENT

Figure 1:
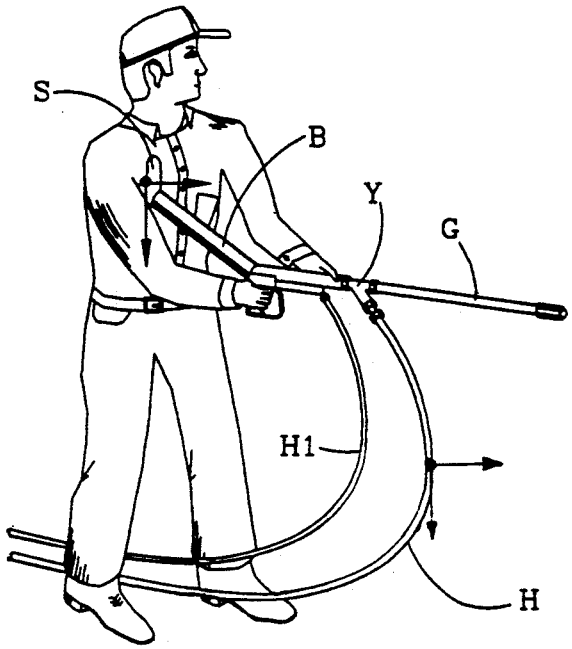
FIG. 1 is a schematic drawing showing an operator holding the high pressure gun and the various thrust components created in operating the gun.

The preferred embodiment of the present invention is shown in FIG. 1 which includes an adjustable shoulder brace B with a rotatable stock S for accommodating the physique of the operator. The brace B is aligned relative to the gun barrel G in such a way as to lower the center of gravity of the gun and distribute the reaction thrust from the gun to produce a resultant force against the shoulder of the operator which is counteracted by forces as shown in FIG. 1. The net result is that the upward thrust component from the gun is minimized so as to make operation of the gun less tiring. Also, the high pressure inlet hose H is connected to the gun barrel G by means of a "Y" fitting designated generally Y that aligns the hose H in such a manner that the resultant force from the tendency of the hose to straighten itself tends to urge the gun barrel G in a forward rather than a backward direction as shown by the hose thrust diagram in FIG. 1.

Figure 2:
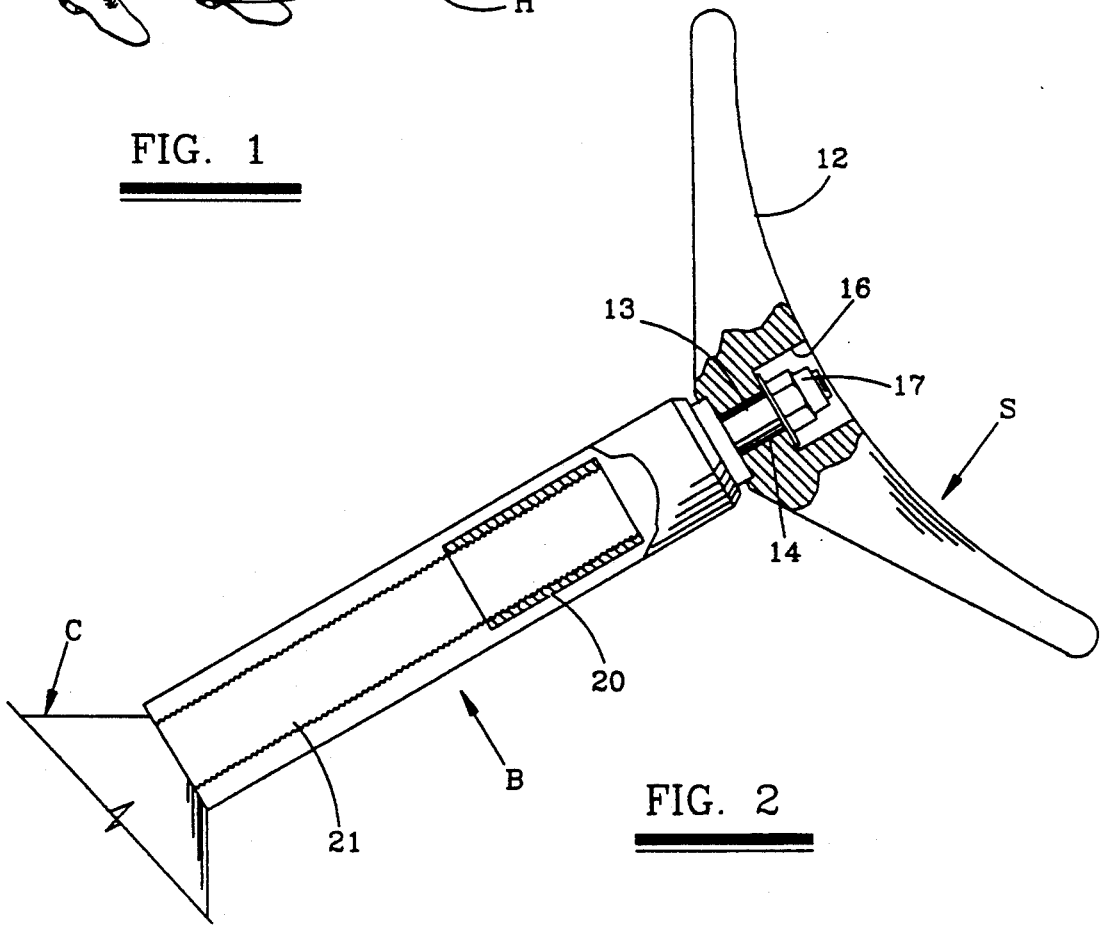
FIG. 2 shows the adjustable shoulder support portion of the gun.

As shown in FIG. 2, the rotatable stock S comprises a curved shoulder engaging member 12 which has a central bore 13 for receiving a threaded bolt 14 in a counterbore 16 for receiving the recessed nut 17. The bolt 14 fits loosely enough in the bore 13 so as to be freely rotatable thereabout and accommodate itself to the particular curvature of the shoulder of the operator. To further accommodate the physique of the individual operator, the brace B is adjustable in length and for this purpose includes a threaded sleeve 20 which engages a threaded shaft 21 attached to the control chamber housing indicated generally C.

Figure 4:
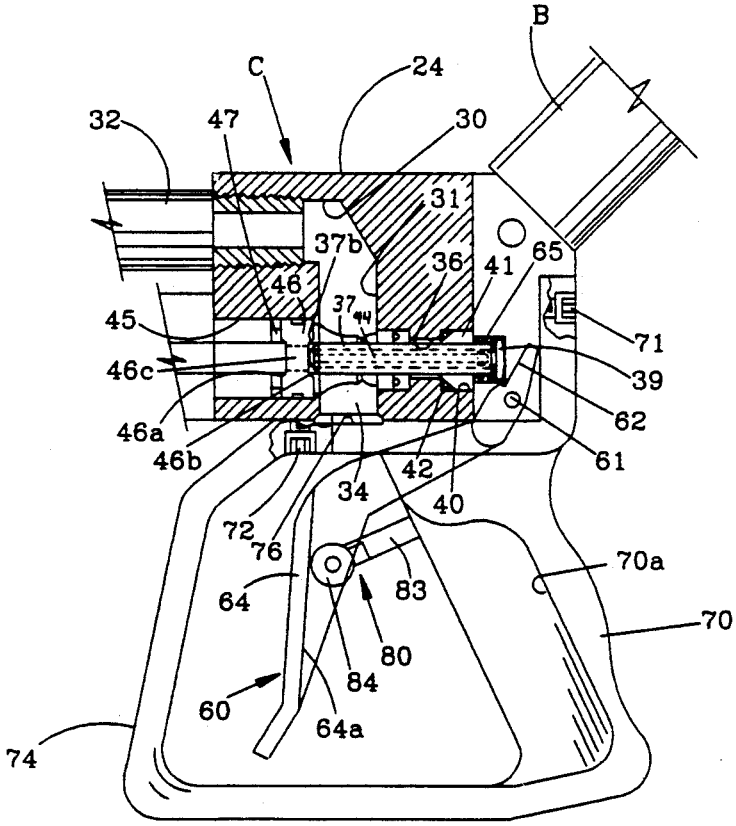
FIG. 4 is a view partly in section showing internal construction details of the gun.

As shown in FIG. 4, this housing C comprises a chamber block 24 having a generally "L" shaped high pressure chamber formed of intersecting bores 30 and 31. The bore 30 is threaded to receive the stub barrel 32 and the bore 31 is closed with a threaded plug 34. A piston chamber 36 is provided in the block 24 for receiving the reversible piston 37. A first counterbore 40 is provided at the rear end of the piston chamber 36 for receiving a bronze bushing 41 which floats so as to maintain sliding contact with the piston 37 and an "O" ring 42 acts as a spring to allow the piston 37 to align itself with the seal. A forward counterbore 45 is also provided in the block 24 and extends around the piston chamber 36 for receiving a reversible seat 46. The piston chamber 36 is sufficiently larger in diameter than the piston 37 so that the piston 37 does not engage the wall around the chamber 36.

The reversible seat 46 has inwardly tapered shoulders **46*a* and 46*b* extending around the passage 46*c* which extends through the seat 46. As shown, the inclined shoulder 46*b* is tapered to receive the inclined shoulder 37*b* formed on the one end of the reversible piston 37. A similar shoulder is provided on the opposite end of the reversible piston 37. The reversible seat 46 engages a crushable alignment ring 47 which extends around the circumference of the seat 46. The crushable ring 47 is deformed on the first loading of the seat 46 by the piston 37 and allows the seat 46 to align itself with respect to the piston 37**.

The reversible piston 37 is formed of a hollow cylinder of tungsten carbide and has a central opening extending therethrough. A retaining bolt 44 extends through the central passage and is threaded into a stainless steel cap or trigger button 39 that is engaged by the trigger mechanism in a manner to be described in more detail hereinafter.

Figure 3:
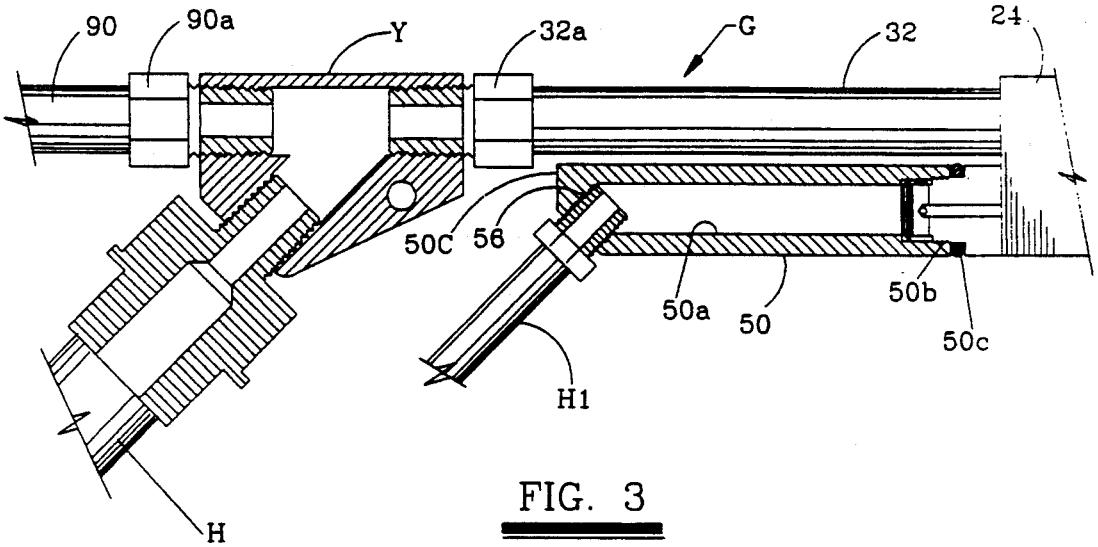
FIG. 3 shows details of the dump chamber and the high pressure fluid inlet of the present invention.

Referring to FIG. 3, the dump chamber body 50, a longitudinally extending hollow body having a passage 50*a* therein, is provided with threads 50*b* at one end for connection to the block 24 adjacent an O ring seal 50*c* that surrounds the end of the body 50 and provides a seal between the body 50 and the block 24. The opposite end of the body 50 has a threaded opening 56 which is inclined at an angle relative to the longitudinal axis of the body 50*a*. Such threaded opening 56 is provided for receiving a threaded coupling on a dump hose H1 for conveying fluid discharged through the dump chamber 50*a* to a remote location, as desired.

Referring now to FIG. 4, a trigger or actuating lever 60 is mounted on a pin 61. As shown in FIG. 4 of the drawings the trigger 60 is shown in the open position with the end 37*b* of the piston 37 spaced laterally away from the seat 46*b* so as to allow high pressure fluid passing through the passages 30 and 31 to be dumped through the dump chamber 50*a* and the attached hose. The trigger 60 has a cam arm 62 that is at the upper end and engages the button 39 on the outer end of the piston 37 to urge the piston forward into engagement with the seat 46. As shown, a return spring 65 is provided in the block 24 surrounding the piston 37 for normally urging the piston into the open position which would allow the high pressure fluid to pass through the control assembly in the dump chamber and hose.

The lower portion of the trigger 60 provides the finger engaging arm 64 which extends below the block 24 and is surrounded by the open handle 70. The handle 70 is attached to the block 24 by means of set screws 71 and 72 and has a trigger guard 74 that extends below and around in front of the trigger 60 to protect it from accidental engagement. The handle has a recess 76 for receiving the plug 34 for further securing the plug 34 in the body 24.

A further protective mechanism is the spring loaded safety 80 which is attached to the handle 70 near the upper end of the recess 70*a* that is provided in the handle for accommodating lateral movement of the trigger arm 64. As shown, the safety comprises a pivoted shaft 83 having a roller 84 which is adapted to engage the surface 64*a* on the rear side of the trigger arm 64. When the trigger is in the open position shown in the drawings, the safety mechanism springs up and effectively holds the trigger against movement from an open to a closed position thus requiring that the operator manually depress the safety 80 to be able to move the trigger arm 64 backward toward the handle 70 and thereby urge the piston 37 forward into engagement with the seat 46 closing off fluid flow through the passage 46*c* and diverting high pressure fluid that enters the barrel G through the "Y" valve Y outwardly through the open forward end of the barrel G.

Also, as shown in FIG. 3, the stub barrel 32 has a shield 32*a* which encircles the forward end adjacent the "Y" shaped connector Y. The stub barrel 32 is only slightly longer than the dump barrel 50 to prevent accidental removal of the dump barrel 50 from the block 24. This is accomplished by having a space between the end 50*c* of the dump barrel and the shield 32*a* shorter than the length of the threads 50*b* on the end of the dump barrel 50 that is threaded onto the block 24. Thus, it is acceptable to rotate or swivel the dump barrel 50 so as to align the hose H1 connected at the discharge end 56 on either side of the operator in whatever direction he wishes without turning the dump barrel 50 a sufficient number of turns to backoff the threads 50*b* and thereby cause a leak or other serious problem in operating the gun.

In assembling the gun, of course, the dump barrel 50 is attached to the block 24 prior to the time in which the stub barrel 32 is attached to the block 24 to thereby assemble the gun and yet still have the safety factor thus built in.

Also as shown in the drawings, there is a barrel extension 90 which is attached to the forward end of the "Y" shaped fitting Y through which the high pressure fluid is discharged when the gun is in operation. The barrel 90 includes a forward shield 90*a* which is adjacent the "Y" fitting. Both shields 90*a* and 32*a* provide diverters to divert any high pressure fluid that may escape around the threaded ends of the stub barrel 32 and the barrel extension 90.

Having described the invention above, various modifications of the techniques, procedures, material and equipment will be apparent to those in the art. It is intended that all such variations within the scope and spirit of the appended claims be embraced thereby.

I claim:

1. In a manually operated high pressure fluid spray gun comprising a housing having an inlet passage, a discharge passage, a dump passage and valve means for selectively opening and closing flow through the dump passage to cause the discharge of high pressure fluid through either the dump passage or the discharge passage, the improvement comprising:

a swivel for connecting the dump passage to a dump hose for alternating the alignment of the dump hose to either side of the operator, an adjustable support connected to the housing for transferring reaction forces from the operation of the high pressure spray gun to the operator wherein said adjustable support includes means for varying the distance of said adjustible support from the housing wherein said adjustable support includes a threaded shaft and a threaded sleeve, wherein the shaft is engaged to a curved shoulder member having a rotatable stock, a counter bore to engage the shaft and a nut for securing the curved member to the the threaded shaft, and a threaded plug means for closing one end of the inlet passage and a handle means secured to the housing for supporting the housing with recess means in the handle means for receiving and reinforcing said plug means to secure said plug means in the housing and lowering the center of gravity of the high pressure fluid spray gun for distributing the reaction thrust from the high pressure fluid spray gun to produce a resultant force against the shoulder of the operator, thereby improving the ergonomics of the high pressure fluid spray gun.

2. The high pressure fluid spray gun as described in claim 1, wherein the adjustable shoulder engaging means comprises:

a rotatable shoulder engaging bracket for fitting the shoulder engaging means to operators of different size and physique.

3. In a manually operated high pressure fluid spray gun comprising a housing having an inlet passage, a discharge passage, and a dump passage therein with valve means for selectively opening and closing flow through said dump passage to cause the discharge of high pressure fluid through said dump passage or said discharge passage the improvement comprising:

a "Y" shaped connection in said inlet passage ahead of said valve means and having a downwardly and forwardly extending branch for connecting a high pressure hose thereto whereby said high pressure hose will tend to be straightened by the flow of high pressure fluid therethrough and such straightening hose will impart a lifting thrust to the forward end of said gun, and reversibly seat means and double ended reversible piston means having sealing surfaces at the opposite ends thereof adapted to engage said seat means to close off fluid passage through the dump passage, and said piston means comprising a longitudinally extending hollow body and including a screw means extending therethrough for securing a dome-shaped button on one end for engagement by a piston actuator, and a crushable alignment ring for engagement by said reversible seat means to facilitate alignment of said seat means with respect to said piston means.

4. In a manually operated high pressure fluid spray gun comprising a housing having an inlet passage, a discharge passage and a dump passage therein with valve means for selectively opening and closing flow through said dump passage to cause the discharge of high pressure fluid through said dump passage or said discharge passage the improvement comprising:

a "Y" shaped connection in said inlet passage ahead of said valve means and having a downwardly and forwardly extending branch for connecting a high pressure hose thereto whereby said high pressure hose will tend to be straightened by the flow of high pressure fluid therethrough and such straightening hose will impart a lifting thrust to the forward end of said gun.

5. The high pressure spray gun as described in claim 4, wherein said valve means comprises:

piston means and reversible double sided valve means having sealing faces on opposite sides thereof for sealing with said piston means to close off fluid flow through said dump passage.

6. In a manually operated high pressure fluid spray gun comprising a housing having an inlet passage, a discharge passage and a dump passage therein with valve means for selectively opening and closing flow through said dump passage to cause the discharge of high pressure fluid through said dump passage or said discharge passage wherein said valve means includes:

seat means and double ended reversible piston means having sealing surfaces at the opposite ends thereof adapted to engage said seat means to close off fluid passage through said dump passage, and the piston means comprising a longitudinally extending hollow body and includes a screw means extending therethrough for securing a dome-shaped button on one end for engagement by a piston actuator.

7. In a manually operated high pressure fluid spray gun comprising a housing having an inlet passage, a discharge passage and a dump passage therein with valve means for selectively opening and closing flow through said dump passage to cause the discharge of high pressure fluid through said dump passage or said discharge passage wherein said valve means comprises:

seat means and double ended reversible piston means having sealing surfaces at the opposite ends thereof adapted to engage said seat means to close off fluid passage through said dump passage, and plug means for closing the one end of said inlet passage and handle means secured to said housing for supporting said housing with recess means in said handle means for receiving and reinforcing said plug means to secure said plug means in said housing.

8. In a manually operated high pressure fluid spray gun comprising a housing having an inlet passage, a discharge passage and a dump passage therein with valve means for selectively opening and closing flow through said dump passage to cause the discharge of high pressure fluid through said dump passage or said discharge passage wherein said valve means comprises:

reversible seat means and double ended reversible piston means having sealing surfaces at the opposite ends thereof adapted to engage said seat means to close off fluid passage through said dump passage, and a crushable alignment ring for engagement by said reversible seat means to facilitate alignment of said seat means with respect to said piston means.

9. In a manually operated high pressure fluid spray gun comprising a housing having an inlet passage, a discharge passage, and a dump passage, therein with valve means for selectively opening and closing flow through said dump passage to cause the discharge of high pressure fluid through said dump passage or said discharge passage the improvement comprising:

an adjustable shoulder engaging means connected to said housing for transferring reaction forces from the operation of a high pressure spray gun to the shoulder of the operator wherein said adjustable means includes means for varying the distance of said shoulder engaging means from said housing, and further comprising a plug means for closing the one end of said inlet passage and handle means secured to said housing for supporting said housing with recess means in said handle means for receiving and reinforcing said plug means to secure said plug means in said housing.

* * * * *